US008203088B2

(12) United States Patent
Gottschalk et al.

(10) Patent No.: US 8,203,088 B2
(45) Date of Patent: Jun. 19, 2012

(54) ELECTRICAL SWITCHING APPARATUS AND CLOSE LATCH INTERLOCK ASSEMBLY THEREFOR

(75) Inventors: Andrew L. Gottschalk, Pittsburgh, PA (US); Perry R. Gibson, East Palestine, OH (US); Robert M. Slepian, Murrysville, PA (US)

(73) Assignee: Eaton Corporation, Cleveland, OH (US)

( * ) Notice: Subject to any disclaimer, the term of this patent is extended or adjusted under 35 U.S.C. 154(b) by 262 days.

(21) Appl. No.: 12/750,767

(22) Filed: Mar. 31, 2010

(65) Prior Publication Data

US 2011/0240445 A1 Oct. 6, 2011

(51) Int. Cl.
*H01H 9/20* (2006.01)

(52) U.S. Cl. ..... 200/50.01; 200/400

(58) Field of Classification Search ..... 200/50.01, 200/400, 401, 1 R, 11 TC, 17 R, 18, 50.32, 200/50.33, 50.37, 50.38, 50.39, 337, 331, 200/500–501, 244, 239, 250, 318
See application file for complete search history.

(56) References Cited

U.S. PATENT DOCUMENTS

| | | | | |
|---|---|---|---|---|
| 7,449,653 | B2 | 11/2008 | Gibson et al. | |
| 7,459,650 | B2 | 12/2008 | Weister et al. | |
| 7,518,076 | B1 | 4/2009 | Gottschalk et al. | |
| 7,598,467 | B2 | 10/2009 | Gibson et al. | |
| 7,687,733 | B2 * | 3/2010 | Weister et al. | 200/400 |
| 7,956,307 | B2 * | 6/2011 | Ahn | 218/154 |
| 8,063,328 | B2 * | 11/2011 | Gottschalk et al. | 200/400 |

* cited by examiner

*Primary Examiner* — Edwin A. Leon
(74) *Attorney, Agent, or Firm* — Dawn C. Wolff; Martin J. Moran

(57) ABSTRACT

A close latch interlock assembly is provided for an electrical switching apparatus, such as a circuit breaker, which includes a stored energy mechanism, such as a closing spring. The close latch interlock assembly includes a close D-shaft pivotable between a latched and unlatched positions corresponding to the closing spring being chargeable and discharged, respectively. An actuator is movable between an unactuated position corresponding to the close D-shaft being disposed in the latched position, and an actuated position corresponding to the close D-shaft being movable toward the unlatched position. A release member cooperates with the actuator and is pivotably coupled to the first end of a transfer link. The second end of the transfer link extends toward the close D-shaft. When the actuator is moved toward the actuated position, it moves the release member, thereby moving the transfer link and pivoting the close D-shaft toward the unlatched position.

20 Claims, 4 Drawing Sheets

200
204
206
208
210
212
214
216
218
220
222
224
226
228
230
232
236
238
240
242
246
202
104
102
106
108
110
OPERATING MECHANISM

ELECTRICAL SWITCHING APPARATUS AND CLOSE LATCH INTERLOCK ASSEMBLY THEREFOR

BACKGROUND

1. Field

The disclosed concept relates generally to electrical switching apparatus and, more particularly, to electrical switching apparatus, such as circuit breakers. The disclosed concept also relates to close latch interlock assemblies for circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are separable from the stationary electrical contacts.

Among other components, the operating mechanisms of some stored energy circuit breakers, for example, typically include a pole shaft, a trip actuator assembly, a closing assembly and an opening assembly. The trip actuator assembly responds to the trip unit and actuates the operating mechanism. The closing assembly and the opening assembly may have some common elements, which are structured to move the movable electrical contacts between a first, open position, wherein the movable and stationary electrical contacts are separated, and a second, closed position, wherein the movable and stationary electrical contacts are electrically connected. Specifically, the movable electrical contacts are coupled to the pole shaft. Elements of both the closing assembly and the opening assembly, which are also pivotably coupled to the pole shaft, pivot the pole shaft in order to effectuate the closing and opening of the electrical contacts. The closing assembly includes a chargeable stored energy mechanism such as, for example and without limitation, a closing spring, and a close button to actuate (e.g., discharge) the closing spring to facilitate the closing process.

As shown, for example, in FIGS. 1 and 2, such circuit breakers (see circuit breaker 2 partially shown in FIG. 1) typically include an interlock assembly 4 for preventing the closing spring 6 (partially shown in phantom line drawing in FIG. 1) from undesirably or unintentionally discharging. For example and without limitation, such unintended discharges can occur if the operator keeps the close button 8 of the circuit breaker 2 depressed (partially shown in phantom line drawing in FIG. 1), and the circuit breaker 2 is equipped with a motor operator (not shown). It can also result from shock and/or vibration, which causes unintended movement of circuit breaker components (e.g., without limitation, close D-shaft 12).

The interlock assembly 4 includes an elongated linking element, commonly referred to as the close block link 10, which cooperates with the close D-shaft 12 of the circuit breaker 2. More specifically, a first end 14 of the close block link 10 is coupled to a lever 18 of the close D-shaft 12, and a second end 16 extends outwardly away from the close D-shaft 12, as shown. A portion of the second end 16 cooperates with a spring release member 20, as partially shown in phantom line drawing in FIG. 1, when the close button 8 of the circuit breaker 2 is actuated (e.g., depressed downward from the perspective of FIG. 1, as partially shown in phantom line drawing), to release (e.g., discharge) the closing spring 6. Otherwise, when the circuit breaker 2 is not ready to close (e.g., when the closing spring 6 is discharged), the interlock assembly 4 forms an interlock to resist undesired repetitive or unintentional discharging of the closing spring 6.

There is, therefore, room for improvement in electrical switching apparatus, such as circuit breakers, and in close latch interlock assemblies therefor.

SUMMARY

These needs and others are met by embodiments of the disclosed concept, which are directed to a close latch interlock assembly for an electrical switching apparatus, such as a circuit breaker. Among other benefits, the mass of the close latch interlock assembly is not coupled to the close D-shaft of the circuit breaker, thereby minimizing the likelihood of unintended movement of the close D-shaft and possible discharge of the circuit breaker caused, for example and without limitation, by shock and/or vibration.

As one aspect of the disclosed concept, a close latch interlock assembly is provided for an electrical switching apparatus. The electrical switching apparatus includes a housing, separable contacts enclosed by the housing, and an operating mechanism for opening and closing the separable contacts. The operating mechanism includes a stored energy mechanism. The close latch interlock assembly comprises: a close D-shaft structured to be pivotably coupled to the housing, the close D-shaft being structured to pivot between a latched position corresponding to the stored energy mechanism being chargeable, and an unlatched position corresponding to the stored energy mechanism being discharged; an actuator structured to be movably coupled to the housing, the actuator being movable between an unactuated position corresponding to the close D-shaft being disposed in the latched position, and an actuated position corresponding to the close D-shaft being movable toward the unlatched position; a release member structured to cooperate with the actuator; and a transfer link including a first end pivotably coupled to the release member, and a second end extending outwardly from the release member toward the close D-shaft. When the actuator is moved toward the actuated position, the actuator moves the release member, thereby moving the second end of the transfer link and pivoting the close D-shaft toward the unlatched position.

The actuator may be a close button. The close button may comprise a pivot pin, a generally planar portion including a first end and a second end disposed opposite and distal from the first end of the generally planar portion, and a button portion extending outwardly from the generally planar portion between the first end of the generally planar portion and the second end of the generally planar portion. The first end of the generally planar portion may be pivotably coupled to the pivot pin, and the second end of the generally planar portion may be pivotable into and out of engagement with the release member. The close button may further comprise an indicator, wherein the generally planar portion includes an opening extending through the generally planar portion proximate to the second end of the generally planar portion, wherein the indicator is structured to provide a visual indication of whether or not the electrical switching apparatus is ready to close, and wherein the indicator is disposed within the opening.

The close D-shaft may include a recess, wherein the recess is structured to receive a portion of the second end of the transfer link. The second end of the transfer link may include a hook portion, wherein the hook portion extends toward the close D-shaft, and wherein the hook portion is movable into and out of engagement with the close D-shaft at or about the recess. When the actuator is disposed in the unactuated position, the hook portion may not engage the close D-shaft, when the actuator is moved toward the actuated position, the hook portion may move into the recess and engages and pivot the close D-shaft toward the unlatched position, and after the close D-shaft has been moved to the unlatched position, the hook portion may move out of the recess and disengages the close D-shaft.

The release member may comprise an exterior, a first side, and a second side disposed opposite the first side. The first end of the transfer link may be pivotably coupled to the second side of the release member.

As another aspect of the disclosed concept, an electrical switching apparatus comprises: a housing; separable contacts enclosed by the housing; an operating mechanism for opening and closing the separable contacts, the operating mechanism comprising a stored energy mechanism and a close D-shaft, the close D-shaft pivoting between a latched position corresponding to the stored energy mechanism being chargeable, and an unlatched position corresponding to the stored energy mechanism being discharged; and a close latch interlock assembly comprising: an actuator movably coupled to the housing of the electrical switching apparatus, the actuator being movable between an unactuated position corresponding to the close D-shaft being disposed in the latched position, and an actuated position corresponding to the close D-shaft being movable toward the unlatched position, a release member cooperating with the actuator, and a transfer link including a first end pivotably coupled to the release member, and a second end extending outwardly from the release member toward the close D-shaft. When the actuator is moved toward the actuated position, the actuator moves the release member, thereby moving the second end of the transfer link and pivoting the close D-shaft toward the unlatched position.

The electrical switching apparatus may be a circuit breaker, the stored energy mechanism may be a closing spring, and the actuator may be a close button. When the circuit breaker is ready to close, the close button may be actuatable to move the latch interlock assembly to unlatch the close D-shaft, thereby discharging the closing spring to close the separable contacts. When the circuit breaker is not ready to close, the close latch interlock assembly may prevent the close D-shaft from moving to the unlatched position.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
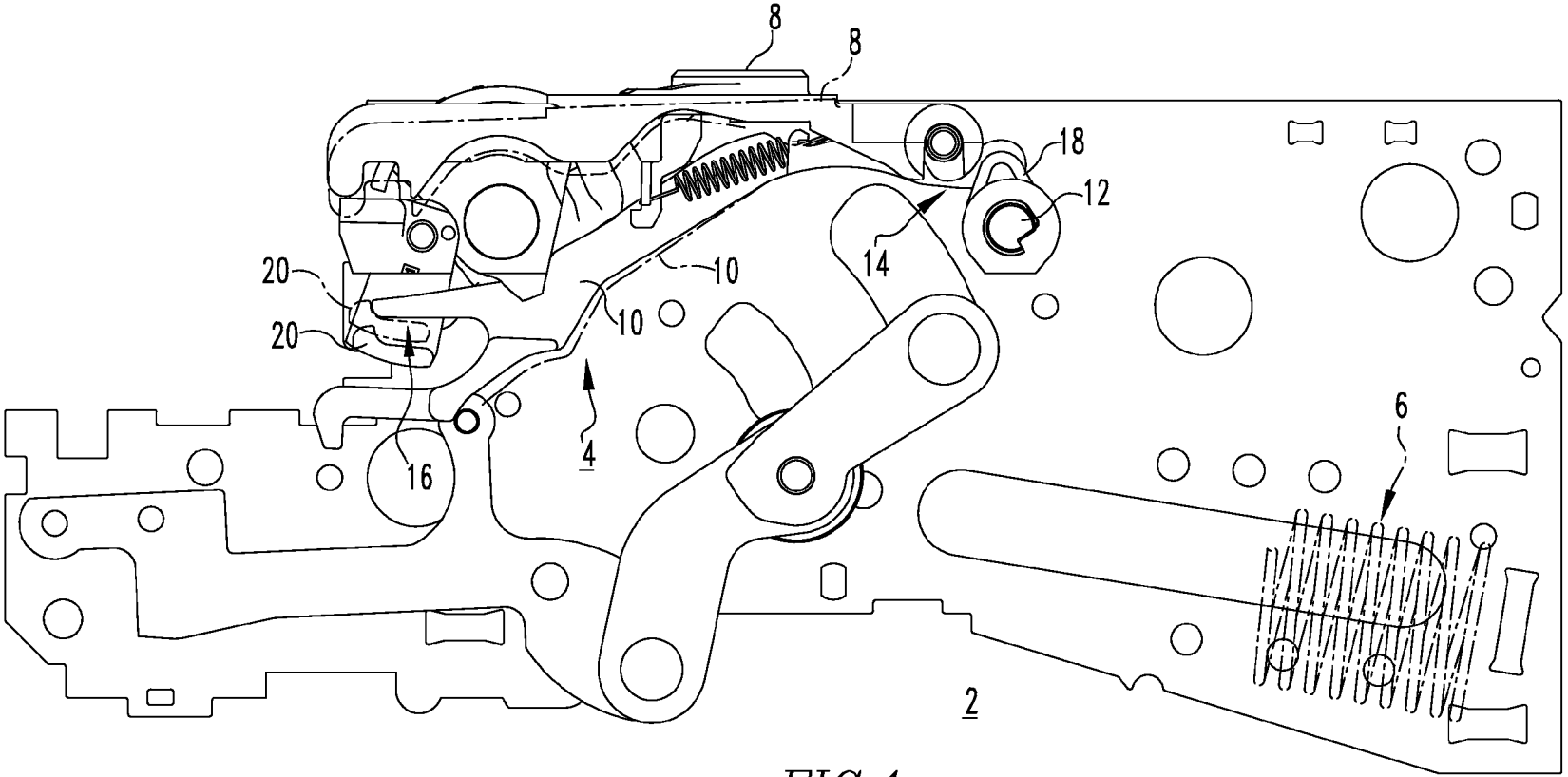
FIG. 1 PRIOR ART
FIG. 1 is a side elevation view of a circuit breaker and a close latch interlock assembly therefor.

Directional phrases used herein, such as, for example, left, right, up, down, clockwise, counterclockwise, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 3:
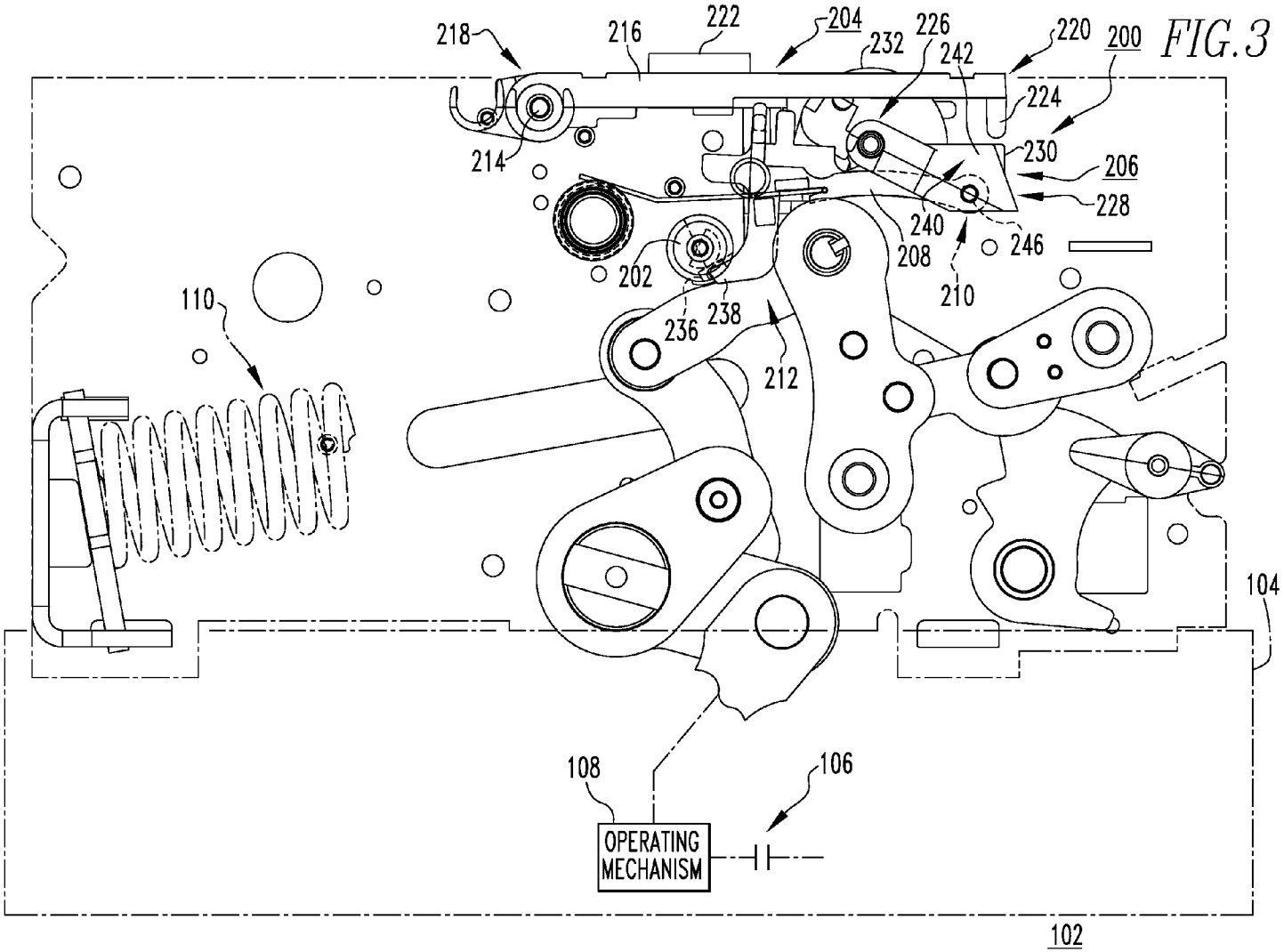
FIG. 3 is a side elevation view of a portion of a circuit breaker and a close latch interlock assembly therefor, in accordance with an embodiment of the disclosed concept, with the circuit breaker housing and hidden components being shown in simplified form.

FIG. 3 shows a close latch interlock assembly 200 for an electrical switching apparatus, such as a circuit breaker 102 (partially shown in simplified form in FIG. 3). The circuit breaker 102 includes a housing 104 (partially shown in simplified form in FIG. 3), separable contacts 106 (shown in simplified form) enclosed by the housing 104, and an operating mechanism 108 (shown in simplified form) for opening and closing the separable contacts 106. The operating mechanism 108 includes a stored energy mechanism such as, for example and without limitation, a closing spring 110 (partially shown in phantom line drawing in FIG. 3).

Figure 4:
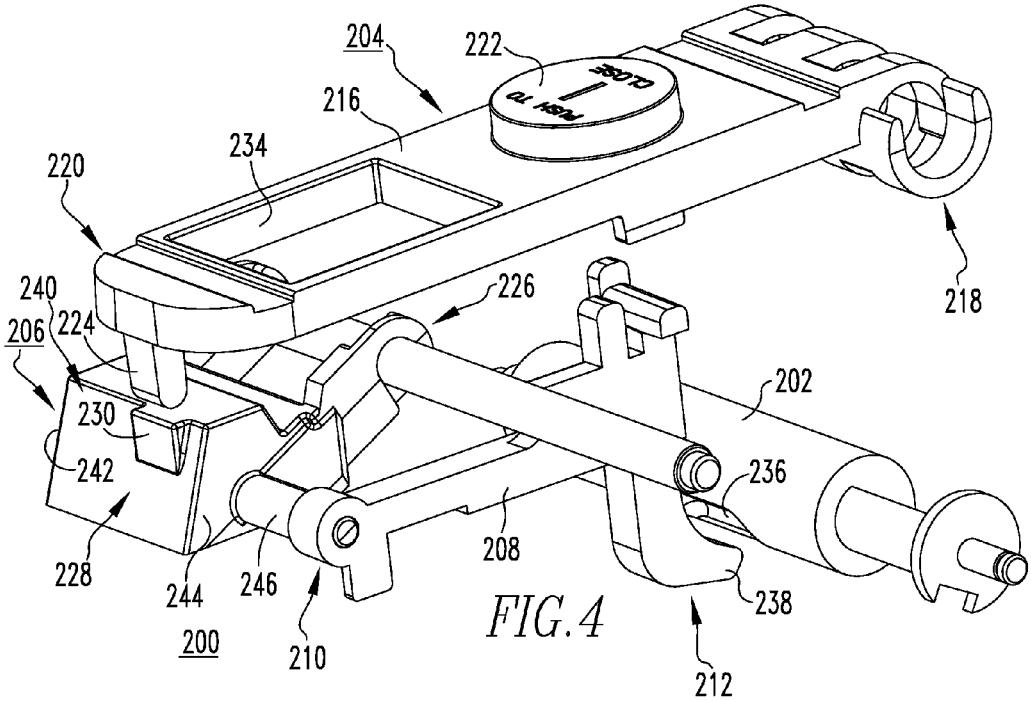
FIG. 4 is an isometric view of the close latch interlock assembly of FIG. 3.
Figure 5:
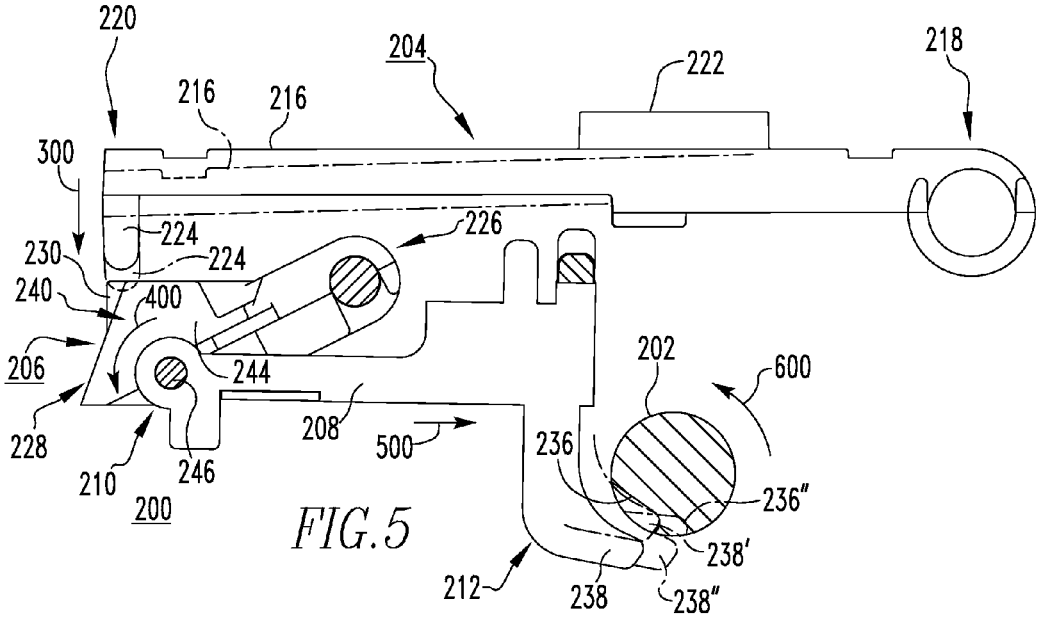
FIG. 5 is a side elevation view of the close latch interlock assembly of FIG. 4.

Continuing to refer to FIG. 3, and also to FIGS. 4 and 5, the interlock assembly 200 includes a close D-shaft 202 pivotably coupled to the circuit breaker housing 104 (FIG. 3). The close D-shaft 202 is structured to pivot (e.g., clockwise and counterclockwise from the perspective of FIGS. 3-5) between a latched position (FIGS. 3 and 4; also shown in solid line drawing in FIG. 5), corresponding to the closing spring 10 (FIG. 3) being charged, and an unlatched position (shown in phantom line drawing in FIG. 5) corresponding to the closing spring 110 (FIG. 3) being discharged. An actuator, which in the example shown and described herein is a close button 204, is movably coupled to the housing 104, for example, by a pivot pin 214, as generally shown in FIG. 3. The close button 204 is movable between an unactuated position (FIG. 3; also shown in solid line drawing in FIG. 5) corresponding to the close D-shaft 202 being disposed in the latched position (FIGS. 3 and 4; also shown in solid line drawing in FIG. 5), and an actuated position (e.g., depressed downwardly from the perspective of FIGS. 3-5, as partially shown in phantom line drawing in FIG. 5) corresponding to the close D-shaft 202 being movable toward the unlatched position (shown in phantom line drawing in FIG. 5).

A release member such as, for example and without limitation, the release paddle 206 shown and described herein, cooperates with the close button 204. Specifically, the close latch interlock assembly 200 further includes a transfer link 208 having a first end 210, which is pivotably coupled to the release paddle 206. The second end 212 of the transfer link 202 extends outwardly from the release paddle 206 toward the close D-shaft 202, as shown. Accordingly, it will be appreciated that, unlike prior art interlock assemblies (see, for example, interlock assembly 4 of FIGS. 1 and 2), wherein the primary linking element (see, for example, link 10 of interlock assembly 4 of FIGS. 1 and 2) of the assembly is mechanically coupled to the close D-shaft (see, for example, first end 14 of link 10 mechanically coupled to lever 18 of close D-shaft 12 in FIGS. 1 and 2), the transfer link 208 of the disclosed close latch interlock assembly 200 is not mechanically coupled to the close D-shaft 202. In this manner, the disclosed close latch interlock assembly 200 advantageously removes (e.g., decouples) the mass of the assembly 200 and, in particular, transfer link 208 thereof, from the close D-shaft 202. Accordingly, the disclosed close latch interlock assembly 200 overcomes the disadvantages of known interlock assemblies (see, for example, interlock assembly 4 of FIGS. 1 and 2), wherein any unbalance of the close D-shaft (see, for example, close D-shaft 12 of FIGS. 1 and 2) caused by the mass of the transfer link (see, for example, link 10 of FIGS. 1 and 2) being connected to the close D-shaft can cause it to undesirably and unintentionally pivot, for example and without limitation, due to shock and/or vibration, thereby unlatching and causing the closing spring (see, for example, closing spring 6 partially shown in phantom line drawing in FIG. 1) to loose its charge.

Figure 2:
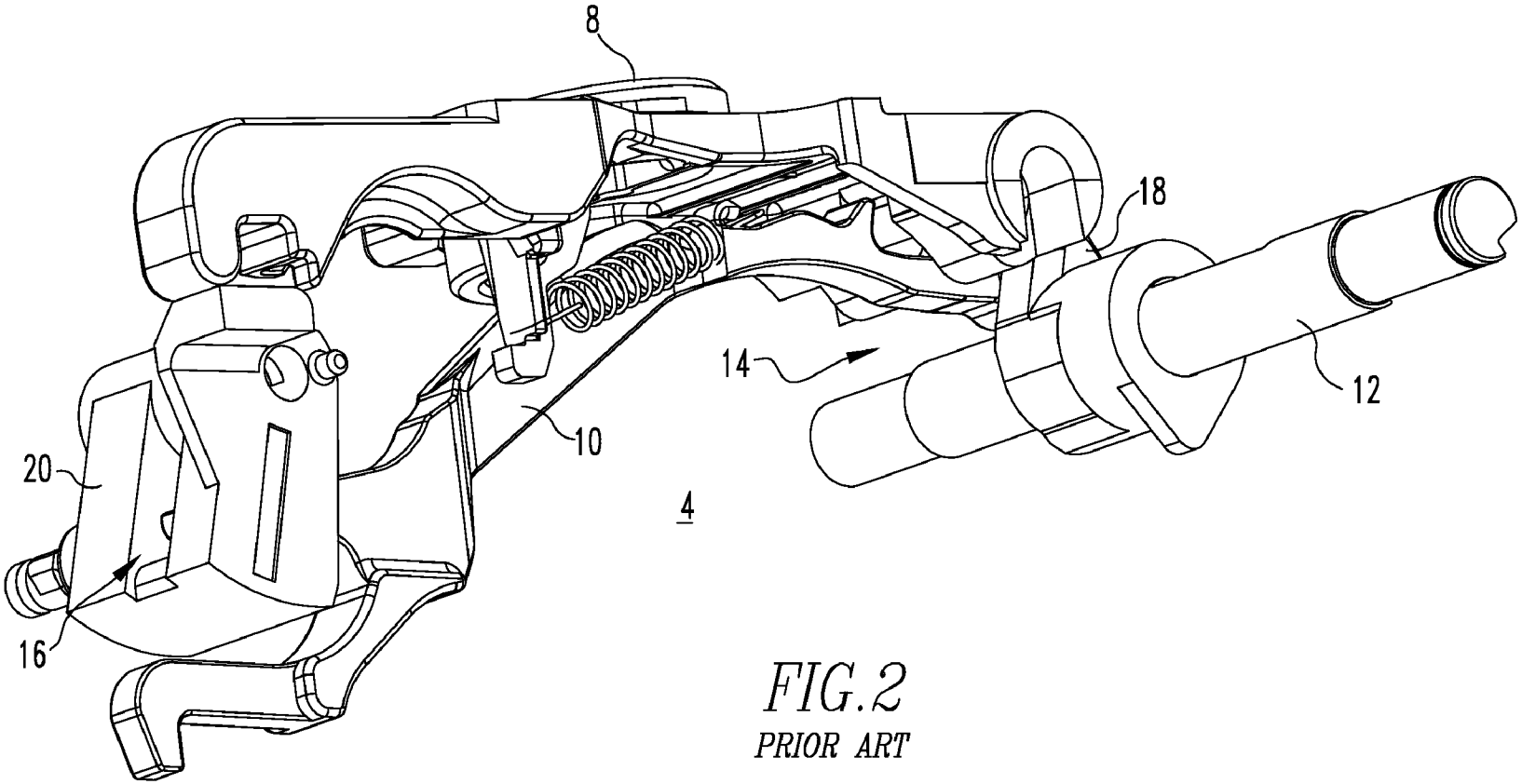
FIG. 2 PRIOR ART
FIG. 2 is a bottom isometric view of the close latch interlock assembly of FIG. 1.

In addition to removing the mass of the transfer link 208 from the close D-shaft 202, among other benefits, the disclosed close latch interlock assembly 200 also reduces tolerance and assembly errors associated with prior art interlock designs (see, for example, interlock assembly 4 of FIGS. 1 and 2), by virtue of the fact that the transfer link 208 and close D-shaft 202 are not directly coupled together, and by improving the interface between the transfer link 208 and close D-shaft 202. Additionally, as will be described in greater detail hereinbelow, the first end 210 of the example transfer link 208 is preferably coupled to the exterior 240 of the release paddle 206, making it easier to inspect than prior art designs, wherein the second end 16 of the link 10 is disposed within, and hidden by, the release member 20, as shown in FIG. 2.

In operation, when the close button 204 is moved (e.g., depressed downwardly in the direction of arrow 300 in FIG. 5) toward the actuated position, shown in phantom line drawing in FIG. 5, the close button 204 moves (e.g., pivots counterclockwise in the direction of arrow 400 of FIG. 5) the release paddle 206, thereby moving (e.g., without limitation, translating to the right in the direction of FIG. 500, from the perspective of FIG. 5, as well as pivoting counterclockwise, in the direction of arrow 600) the second end 212 of the transfer link 208 and pivoting (e.g., counterclockwise in the direction of FIG. 600) the close D-shaft 202 toward the unlatched position (shown in phantom line drawing in FIG. 5). More specifically, the close button 204 includes a generally planar portion 216 having first and second opposing ends 218,220 and a button portion 222, which extends outwardly from the generally planar portion 216 between the first and second ends 218,220, as shown. The first end 218 of the generally planar portion 216 is pivotably coupled to the pivot pin 214, as previously described hereinabove with respect to FIG. 3. The second end 220 is pivotable, about pivot pin 214, into engagement (shown in phantom line drawing in FIG. 5) and out of engagement (shown in solid line drawing in FIG. 5) with the release paddle 206.

The example close button 204 further includes a projection 224 extending outwardly from the second end 220 of the generally planar portion 216, toward the release paddle 206. Thus, when the close button 204 is moved from the unactuated position toward the actuated position, as shown in phantom line drawing in FIG. 5, the projection 224 moves downwardly (e.g., from the perspective of FIG. 5, in the direction of arrow 300) into engagement with the release paddle 206. The example release paddle 206 includes a first portion 226 pivotably coupled to the circuit breaker housing 104 (FIG. 3), a second portion 228 disposed generally opposite the first portion 226, and a protrusion 230. The protrusion 230 extends outwardly from the second portion 228 of the release paddle 206 to provide a more substantial contact area on the release paddle 206 to be engaged by the close button projection 224.

The close button 204 of the close latch interlock assembly 200 preferably further includes an indicator such as, for example and without limitation, the pivotable ready-to-close flag 232, shown in FIG. 3. In the example shown and described herein, the indicator 232 (FIG. 3) is movably disposed within an opening 234, which extends through the generally planar portion 216 of the close button 204 proximate the second end 220 thereof, as shown in FIG. 4. It will be appreciated that the exemplary ready-to-close flag 232 cooperates with the close latch interlock assembly 200 to indicate whether or not the circuit breaker 102 (FIG. 3) is ready to close. For example, FIG. 3 shows the close latch interlock assembly 200 and ready-to-close flag 232 in their respective positions corresponding to the closing spring 110 of the circuit breaker 102 being charged and the separable contacts 106 of the circuit breaker 102 being open, in which case the circuit breaker 102 is ready to close. Under substantially all other circumstances, the circuit breaker 102 is not truly ready to be closed. Therefore, the ready-to-close flag 232 provides a visual indication (e.g., without limitation, color; wording or message) (not shown) that the circuit breaker 102 is not ready to close, and the close latch interlock assembly 200 locks, so as not to provide the necessary interaction between the close button 204 and close D-shaft 202 for closing the circuit breaker 102 and, in particular, discharging the closing spring 110.

As previously discussed, the transfer link 208 of the example close latch interlock assembly 200 is not mechanically coupled to the close D-shaft 202. Rather, the transfer link 208 cooperates with the close D-shaft 202 by way of interaction of the second end 212 of the transfer link 208 with a recess 236 of the close D-shaft 202. Specifically, the second end 212 of the transfer link 202 preferably includes a hook portion 238, which extends generally toward (e.g., without limitation, curves toward) the close D-shaft 202, as shown. The hook portion 238 is movable into and out of engagement with the close D-shaft 202 at or about the recess 236, as shown in FIG. 5. More specifically, as shown in FIG. 3, when the close button 204 is disposed in the unactuated position, the closing spring 110 is charged, and the separable contacts 106 are open, the hook portion 238 of the transfer link 208 is disposed in the recess 236 of the close D-shaft 202.

As shown in solid line drawing in FIG. 5, under other circumstances, for example when the closing spring 110 (FIG. 3) is charged and the separable contacts 106 (FIG. 3) are closed, the close latch interlock assembly 200 and, in particular, the transfer link 208 and hook portion 238 thereof are prevented (e.g., without limitation, locked) from engaging and moving the close D-shaft 202. However, when the closing spring 106 (FIG. 3) is charged, the separable contacts 106 (FIG. 3) are open, and the close button 204 is moved (e.g., depressed downwardly in the direction of arrow 300 of FIG. 5) toward the actuated position, partially shown in phantom line drawing in FIG. 5, the close button projection 224 engages and pivots the release paddle 206, counterclockwise in the direction of arrow 400, which in turn pivots and translates the transfer link 208 in the direction of arrow 500 into engagement with the close D-shaft 202. Specifically, the hook portion 238' of the transfer link 208 is disposed within the recess 236 of the close D-shaft 202, as partially shown in phantom line drawing, so as to pivot (e.g., counterclockwise in the direction of arrow 600 in FIG. 5) the close D-shaft 202 toward the unlatched position (see, for example, recess 236", shown in phantom line drawing in FIG. 5 in the position corresponding to the close D-shaft 202 being unlatched).

Continuing to refer to FIG. 5, it will be appreciated that, after the close D-shaft 202 has been moved to the unlatched position (represented by recess 236" having pivoted counterclockwise in the direction of arrow 600), the hook portion 238" moves out of the recess 236 so as to disengage the close D-shaft 202, as partially shown in phantom line drawing in FIG. 5. In this manner, by disengaging itself from the close D-shaft 202, the transfer link 208 prevents damage that could otherwise occur to the transfer link 208, release paddle 206 and/or close button 204, for example and without limitation, as a result of potential rapid rotation of the close D-shaft 202.

As previously discussed, another advantage of the disclosed close latch interlock assembly 200 relates to the fact that the first end 210 of the transfer link 208 is coupled to the exterior 240 of the release paddle 206. Specifically, as best shown in FIG. 4, the example release paddle 206 includes first and second opposing sides 242,244 and a pivot member 246, which extends laterally outwardly from the second side 244. The first end 210 of the transfer link 208 is pivotably coupled to the pivot member 246 on the exterior 240 of the release paddle 206, as shown. Among other benefits, the exterior location makes it relatively quick and easy to inspect the close latch interlock assembly 200.

Accordingly, the disclosed close latch interlock assembly 200 provides an improved mechanism for controlling the closing operation of the circuit breaker 102 (FIG. 3) and, in particular, discharging the closing spring 110 (FIG. 3) thereof. Among other benefits, the transfer link 208 of the close latch interlock assembly 200 is coupled to the release paddle 206, not the close D-shaft 202, thereby disassociating the mass of the transfer link 208 from the close D-shaft 202 and avoiding undesired or unintentional movement of the close D-shaft 202 toward the unlatched position as a result of such mass hanging from the close D-shaft (see, for example, transfer link 10 mechanically coupled to and extending from D-shaft 12 of FIGS. 1 and 2). Additionally, by not being mechanically coupled directly to the close D-shaft 202, tolerance and assembly errors associated with prior art interlock assembly designs (see, for example, interlock assembly 4 of FIGS. 1 and 2) are also reduced. Moreover, the transfer link 208 of the disclosed close latch interlock assembly 200 is pivotably coupled to the exterior 240 of the release paddle 206 and, therefore, can be readily inspected.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A close latch interlock assembly for an electrical switching apparatus, said electrical switching apparatus including a housing, separable contacts enclosed by the housing, and an operating mechanism for opening and closing said separable contacts, said operating mechanism including a stored energy mechanism, said close latch interlock assembly comprising:

a close D-shaft structured to be pivotably coupled to the housing, said close D-shaft being structured to pivot between a latched position corresponding to said stored energy mechanism being chargeable, and an unlatched position corresponding to said stored energy mechanism being discharged;

an actuator structured to be movably coupled to the housing, said actuator being movable between an unactuated position corresponding to said close D-shaft being disposed in said latched position, and an actuated position corresponding to said close D-shaft being movable toward said unlatched position;

a release member structured to cooperate with said actuator; and a transfer link including a first end pivotably coupled to said release member, and a second end extending outwardly from said release member toward said close D-shaft, wherein, when said actuator is moved toward said actuated position, said actuator moves said release member, thereby moving the second end of said transfer link and pivoting said close D-shaft toward said unlatched position.

2. The close latch interlock assembly of claim 1 wherein said actuator is a close button; wherein said close button comprises a pivot pin, a generally planar portion including a first end and a second end disposed opposite and distal from the first end of said generally planar portion, and a button portion extending outwardly from said generally planar portion between the first end of said generally planar portion and the second end of said generally planar portion; wherein the first end of said generally planar portion is pivotably coupled to said pivot pin; and wherein the second end of said generally planar portion is pivotable into and out of engagement with said release member.

3. The close latch interlock assembly of claim 2 wherein said close button further comprises a projection extending outwardly from the second end of said generally planar portion toward said release member; and wherein, when said close button is moved from said unactuated position toward said actuated position, said close button pivots about said pivot pin, thereby moving said projection into engagement with said release member.

4. The close latch interlock assembly of claim 3 wherein said release member is a release paddle; wherein said release paddle includes a first portion structured to be pivotably coupled to the housing, a second portion disposed generally opposite the first portion, and a protrusion; wherein said protrusion extends outwardly from the second portion of said release paddle; and wherein said projection of said closed button engages said protrusion, thereby moving said release paddle.

5. The close latch interlock assembly of claim 2 wherein said close button further comprises an indicator; wherein said generally planar portion includes an opening extending through said generally planar portion proximate to the second end of said generally planar portion; wherein said indicator is structured to provide a visual indication of whether or not said electrical switching apparatus is ready to close; and wherein said indicator is disposed within said opening.

6. The close latch interlock assembly of claim 1 wherein said close D-shaft includes a recess; and wherein said recess is structured to receive a portion of the second end of said transfer link.

7. The close latch interlock assembly of claim 6 wherein the second end of said transfer link includes a hook portion; wherein said hook portion extends generally toward said close D-shaft; and wherein said hook portion is movable into and out of engagement with said close D-shaft at or about said recess.

8. The close latch interlock assembly of claim 7 wherein, when said actuator is disposed in said unactuated position, said stored energy mechanism is charged, and said separable contacts are open, said hook portion is disposed in said recess of said close D-shaft; wherein, when said stored energy mechanism is charged, said separable contacts are open, and said actuator is moved toward said actuated position, said hook portion engages and pivots said close D-shaft toward said unlatched position; and wherein, after said close D-shaft has been moved to said unlatched position, said hook portion moves out of said recess and disengages said close D-shaft.

9. The close latch interlock assembly of claim 1 wherein said release member comprises an exterior, a first side, and a second side disposed opposite the first side; and wherein the first end of said transfer link is pivotably coupled to the second side of said release member.

10. The close latch interlock assembly of claim 9 wherein said release member further comprises a pivot member; wherein said pivot member extends laterally outwardly from the second side of said release member; and wherein the first end of said transfer link is pivotably coupled to said pivot member on the exterior of said release member.

11. An electrical switching apparatus comprising:

a housing;

separable contacts enclosed by the housing;

an operating mechanism for opening and closing said separable contacts, said operating mechanism comprising a stored energy mechanism and a close D-shaft, said close D-shaft pivoting between a latched position corresponding to said stored energy mechanism being chargeable, and an unlatched position corresponding to said stored energy mechanism being discharged; and a close latch interlock assembly comprising:

an actuator movably coupled to the housing of said electrical switching apparatus, said actuator being movable between an unactuated position corresponding to said close D-shaft being disposed in said latched position, and an actuated position corresponding to said close D-shaft being movable toward said unlatched position, a release member cooperating with said actuator, and a transfer link including a first end pivotably coupled to said release member, and a second end extending outwardly from said release member toward said close D-shaft, wherein, when said actuator is moved toward said actuated position, said actuator moves said release member, thereby moving the second end of said transfer link and pivoting said close D-shaft toward said unlatched position.

12. The electrical switching apparatus of claim 11 wherein said actuator of said close latch interlock assembly is a close button; wherein said close button comprises a pivot pin, a generally planar portion including a first end and a second end disposed opposite and distal from the first end of said generally planar portion, and a button portion extending outwardly from said generally planar portion between the first end of said generally planar portion and the second end of said generally planar portion; wherein the first end of said generally planar portion is pivotably coupled to said pivot pin; and wherein the second end of said generally planar portion is pivotable into and out of engagement with said release member.

13. The electrical switching apparatus of claim 12 wherein said release member of said close latch interlock assembly is a release paddle; wherein said release paddle includes a first portion structured to be pivotably coupled to the housing, a second portion disposed generally opposite the first portion, and a protrusion; wherein said protrusion extends outwardly from the second portion of said release paddle; wherein said close button further comprises a projection extending outwardly from the second end of said generally planar portion toward said release paddle; and wherein, when said close button is moved from said unactuated position toward said actuated position, said close button pivots about said pivot pin, thereby moving said projection into engagement with said protrusion of said release paddle.

14. The electrical switching apparatus of claim 12 wherein said close button further comprises an indicator; wherein said generally planar portion includes an opening extending through said generally planar portion proximate to the second end of said generally planar portion; wherein said indicator provides a visual indication of whether or not said electrical switching apparatus is ready to close; and wherein said indicator is disposed within said opening.

15. The electrical switching apparatus of claim 11 wherein said close D-shaft includes a recess; and wherein said recess receives a portion of the second end of said transfer link of said close latch interlock assembly.

16. The electrical switching apparatus of claim 15 wherein the second end of said transfer link includes a hook portion; wherein said hook portion extends generally toward said close D-shaft; and wherein said hook portion is movable into and out of engagement with said close D-shaft at or about said recess.

17. The electrical switching apparatus of claim 16 wherein, when said actuator is disposed in said unactuated position, said stored energy mechanism is charged, and said separable contacts are open, said hook portion is disposed in said recess of said close D-shaft; wherein, when said stored energy mechanism is charged, said separable contacts are open, and said actuator is moved toward said actuated position, said hook portion engages and pivots said close D-shaft toward said unlatched position; and wherein, after said close D-shaft has been moved to said unlatched position, said hook portion moves out of said recess and disengages said close D-shaft.

18. The electrical switching apparatus of claim 11 wherein said release member of said close latch interlock assembly comprises an exterior, a first side, and a second side disposed opposite the first side; and wherein the first end of said transfer link is pivotably coupled to the second side of said release member.

19. The electrical switching apparatus of claim 18 wherein said release member further comprises a pivot member; wherein said pivot member extends laterally outwardly from the second side of said release member; and wherein the first end of said transfer link is pivotably coupled to said pivot member on the exterior of said release member.

20. The electrical switching apparatus of claim 11 wherein said electrical switching apparatus is a circuit breaker; wherein said stored energy mechanism is a closing spring; wherein said actuator is a close button; wherein, when said circuit breaker is ready to close, said close button is actuatable to move said latch interlock assembly to unlatch said close D-shaft, thereby discharging said closing spring to close said separable contacts; and wherein, when said circuit breaker is not ready to close, said close latch interlock assembly prevents said close D-shaft from moving to said unlatched position.

* * * * *